US011006763B1

(12) United States Patent
Oh

(10) Patent No.: US 11,006,763 B1
(45) Date of Patent: May 18, 2021

(54) ADJUSTABLE METAL BED FRAME ASSEMBLEABLE WITHOUT USING BOLTS

(71) Applicant: Grantec (Xiamen) Co., Ltd, Xiamen (CN)

(72) Inventor: Suk Kan Oh, Xiamen (CN)

(73) Assignee: Grantec (Xiamen) Co., Ltd, Xiamen (CN)

( * ) Notice: Subject to any disclaimer, the term of this patent is extended or adjusted under 35 U.S.C. 154(b) by 0 days.

(21) Appl. No.: 16/842,692

(22) Filed: Apr. 7, 2020

(51) Int. Cl.
*A47C 19/12* (2006.01)
*A47C 19/02* (2006.01)

(52) U.S. Cl.
CPC ..... *A47C 19/124* (2013.01); *A47C 19/021* (2013.01)

(58) Field of Classification Search
CPC ..... A47C 19/124; A47C 19/021; A47C 19/005; A47C 19/12; A47C 19/14; A47C 19/126; A47C 19/122
See application file for complete search history.

(56) References Cited

U.S. PATENT DOCUMENTS 2,772,424 A * 12/1956 Roche ..... A47C 19/124 5/176.1
2,985,894 A * 5/1961 Goldberg ..... A47C 19/124 5/176.1
3,123,837 A * 3/1964 Paine et al. ..... A47C 19/04 5/181
3,329,975 A * 7/1967 Hooker ..... A47C 19/04 5/8
3,555,579 A * 1/1971 Harris ..... A47C 19/005 5/176.1
3,995,334 A * 12/1976 Harris ..... A47C 19/005 5/202
4,007,502 A * 2/1977 Mis ..... A47C 19/005 5/202
4,027,343 A * 6/1977 Hooker ..... A47C 19/005 5/200.1
6,338,172 B1 * 1/2002 Taylor ..... A47C 19/005 5/184
8,869,324 B1 * 10/2014 Lin ..... A47C 19/021 5/400
8,978,176 B1 * 3/2015 Oh ..... A47C 19/12 5/400
9,414,690 B2 * 8/2016 Harrow ..... A47C 19/005
10,813,466 B2 * 10/2020 Jin ..... A47C 19/122
2008/0168602 A1 * 7/2008 DiForio ..... A47C 19/04 5/184

(Continued)

*Primary Examiner* — Eric J Kurilla

(57) ABSTRACT

An adjustable bed frame includes first and second bed frame units. The first bed frame unit includes a first longitudinal rod, a second longitudinal rod, a first transverse rod, and a first vertical rod. The first longitudinal rod, the second longitudinal rod, and the first transverse rod are all pivotally attached to the first vertical rod. A locating hole passes through a side of the first transverse rod. The second bed frame unit includes a third longitudinal rod, a fourth longitudinal rod, a second transverse rod, and a second vertical rod. The third longitudinal rod, the fourth longitudinal rod, and the fourth transverse rod are all pivotally attached to the second vertical rod. A locating pin is disposed on a side of the second transverse rod. In an assembled state, the second transverse rod fits inside the first transverse rod, and the locating pin protrudes out through the locating hole.

20 Claims, 6 Drawing Sheets

(56) References Cited

U.S. PATENT DOCUMENTS

| | | | | |
|---|---|---|---|---|
| 2010/0031440 | A1* | 2/2010 | Harrow | A47C 19/005 5/201 |
| 2010/0299831 | A1* | 12/2010 | Lee | A47C 19/126 5/202 |
| 2012/0246826 | A1* | 10/2012 | Jin | A47C 19/04 5/400 |
| 2015/0143630 | A1* | 5/2015 | Harrow | A47C 19/12 5/400 |
| 2016/0206110 | A1* | 7/2016 | Oh | A47C 19/12 |
| 2016/0206112 | A1* | 7/2016 | Oh | A47C 19/126 |
| 2018/0042391 | A1* | 2/2018 | Oh | A47C 19/027 |
| 2018/0192778 | A1* | 7/2018 | Choi | A47C 19/027 |
| 2019/0387889 | A1* | 12/2019 | Choi | A47C 19/025 |
| 2020/0022503 | A1* | 1/2020 | Choi | A47C 19/12 |

* cited by examiner

ADJUSTABLE METAL BED FRAME ASSEMBLEABLE WITHOUT USING BOLTS

CROSS REFERENCE TO RELATED APPLICATION

This application is based on and hereby claims the benefit under 35 U.S.C. § 119 from Chinese Patent Application No. CN 202020028061.X, filed on Jan. 7, 2020, in the Chinese Patent Office. This application is a continuation-in-part of Chinese Patent Application No. CN 202020028061.X, the contents of which are incorporated herein by reference.

TECHNICAL FIELD

The invention relates to the field of bed frame, in particular to a novel bed frame.

BACKGROUND

A folding bed frame is a simple bed frame that can be folded in different folding ways to achieve the joint goals of convenience and space savings. A folding bed frame is convenient, practical and easy to store.

Existing folding bed frames reduce the amount of occupied space through folding and thereby save on transportation costs and facilitate storage. However, the main parts of the bed frame cannot be folded, so the folded bed frame still occupies a large amount of space.

SUMMARY

A novel adjustable metal bed frame includes a first bed frame unit and a second bed frame unit. The first bed frame unit includes a first longitudinal rod, a second longitudinal rod, a first transverse rod, a second transverse rod, a third transverse rod, and a first vertical rod. The first longitudinal rod, the second longitudinal rod, and the first transverse rod are all pivotally attached to the first vertical rod. A first locating hole passes through a side of the first transverse rod. The second bed frame unit includes a third longitudinal rod, a fourth longitudinal rod, a fourth transverse rod, a fifth transverse rod, a sixth transverse rod, and a second vertical rod. The third longitudinal rod, the fourth longitudinal rod, and the fourth transverse rod are all pivotally attached to the second vertical rod. A locating pin is disposed on a side of the fourth transverse rod. In an assembled state of the bed frame, the fourth transverse rod fits inside the first transverse rod, and the locating pin protrudes out through the first locating hole in the first transverse rod.

The novel bed frame includes first and second bed frame units that cooperate with each other in a telescoping manner. The first bed frame unit includes a first vertical rod, a second vertical rod, a third vertical rod, a first transverse rod, a second transverse rod, a third transverse rod, a first longitudinal rod and a second longitudinal rod which can be folded in bundle. The second bed frame unit includes a fourth vertical rod, a fifth vertical rod, a sixth vertical rod, a fourth transverse rod, a fifth transverse rod, a sixth transverse rod, a third longitudinal rod and a fourth longitudinal rod which can be folded in bundle. The first transverse rod and the fourth transverse rod, the second transverse rod and the fifth transverse rod, and the third transverse rod and the sixth transverse rod are arranged pairwise in a sliding connection. The first bed frame unit and the second bed frame unit can be split into two parts and then folded so that the rod pieces forming the first bed frame unit and the second bed frame unit can be folded separately into bundle structures so as to achieve a smaller packaging volume after folding, to save storage space and to reduce transportation costs.

The object of the invention is to provide a novel bed frame that occupies a smaller amount of space after being folded and thereby saves storage space and reduces transportation costs. To achieve this objective, a novel bed frame is designed that includes a first bed frame unit and a second bed frame unit.

The first bed frame unit includes a first longitudinal rod, a second longitudinal rod, a first transverse rod, a second transverse rod, a third transverse rod, a first vertical rod, a second vertical rod, and a third vertical rod. At the upper end of the first vertical rod, the first transverse rod, the first longitudinal rod and the second longitudinal rod all pivot at one of their ends. All three rods are adapted to rotate downwards and to fold relative to the first vertical rod. An end of the second transverse rod pivots at the other end of the first longitudinal rod, and is capable of horizontally rotating and being folded relative to the first longitudinal rod.

An end of the third transverse rod pivots at the other end of the second longitudinal rod and is capable of horizontally rotating and being folded relative to the second longitudinal rod. The upper end of the second vertical rod pivots at an end of the second transverse rod close to the first longitudinal rod and is capable of rotating upwards and being folded relative to the second transverse rod. The upper end of the third vertical rod pivots at an end of the third transverse rod close to the second longitudinal rod and is capable of rotating upwards and being folded relative to the third transverse rod.

The second bed frame unit includes a third longitudinal rod, a fourth longitudinal rod, a fourth transverse rod, a fifth transverse rod, a sixth transverse rod, a fourth vertical rod, a fifth vertical rod, and a sixth vertical rod. At the upper end of the fourth vertical rod, the fourth transverse rod, the third longitudinal rod and the fourth longitudinal rod all pivot at one of their ends. All three rods are adapted to rotate downwards and to fold relative to the fourth vertical rod.

An end of the fifth transverse rod pivots at the other end of the third longitudinal rod and is capable of horizontally rotating and being folded relative to the third longitudinal rod. An end of the sixth transverse rod pivots at the other end of the fourth longitudinal rod and is capable of horizontally rotating and being folded relative to the fourth longitudinal rod. The upper end of the fifth vertical rod pivots at one end of the fifth transverse rod close to the third longitudinal rod and is capable of rotating upwards and being folded relative to the fifth transverse rod. The upper end of the sixth vertical rod pivots at one end of the sixth transverse rod close to the fourth longitudinal rod and is capable of rotating upwards and being folded relative to the sixth transverse rod. The pairs of the first transverse rod and the fourth transverse rod, the second transverse rod and the fifth transverse rod, and the third transverse rod and the sixth transverse rod are each arranged opposite to one another in a sliding fit so that the spacing between the first longitudinal rod and the third longitudinal rod is adjustable.

The length of the first longitudinal rod is equal to that of the third longitudinal rod, and the length of the second longitudinal rod is equal to that of the fourth longitudinal rod. The first vertical rod, the second vertical rod, the third vertical rod, the fourth vertical rod, the fifth vertical rod and the sixth vertical rod are all of the same length.

The first bed frame unit further comprises a seventh vertical rod, an eighth vertical rod and a ninth vertical rod;

the upper end of the seventh vertical rod is pivoted at one end of the first transverse rod far from the first vertical rod, and the upper end of the eighth vertical rod is pivoted at one end of the second transverse rod far from the first longitudinal rod; the upper end of the ninth vertical rod is pivoted at one end of the third transverse rod far from the second longitudinal rod.

The first vertical rod, the second vertical rod, the third vertical rod, the fourth vertical rod, the fifth vertical rod, the sixth vertical rod, the seventh vertical rod, the eighth vertical rod and the ninth vertical rod are of the same length.

The first transverse rod, the second transverse rod and the third transverse rod are spliced around the fourth transverse rod, the fifth transverse rod and the sixth transverse rod, respectively, in order to realize sliding fit. A first locating structure is provided between two transverse rods in splicing fit, so as to achieve location fit between two transverse rods. The first locating structure comprises a first locating pin arranged on one transverse rod and several first locating holes arranged on another transverse rod, and the first locating pin fits into one of the first locating holes in an assembled state. The first locating holes are evenly spaced along the axial direction of another transverse rod.

A second locating structure is provided between two rod pieces in pivoting relations, so as to achieve location fit between two rod pieces in the assembled state. The second locating structure comprises a locking locating pin arranged on one rod piece and a locking locating hole arranged on another rod piece, and the locking locating pin fits into the locking locating hole in the assembled state.

Upon adoption of the above technical solution, the first bed frame unit and the second bed frame unit can be split into two parts and then folded so that the rod pieces forming the first bed frame unit and the second bed frame unit can be folded separately and finally folded as a bundle structure, consequently to achieve a smaller space after folding, to save storage space and to reduce transportation costs.

Other embodiments and advantages are described in the detailed description below. This summary does not purport to define the invention. The invention is defined by the claims.

BRIEF DESCRIPTION OF THE DRAWING

The accompanying drawings, where like numerals indicate like components, illustrate embodiments of the invention.

DETAILED DESCRIPTION

Reference will now be made in detail to some embodiments of the invention, examples of which are illustrated in the accompanying drawings. Unless otherwise specified, "vertical", "transverse" and "longitudinal" herein refer to the orientation of the rod pieces in the assembled state, and the folding direction refers to the opposite direction when folding in the assembled state. The assembled state refers to the form when the product is unfolded and used, and the folded state refers the form when the product is fully folded and compact. In the description and claims, terms such as "upwards", "downwards", "horizontally", "top", "bottom", "upper", "lower", "up" and "down" are used to describe relative directions and orientations between different parts of the bed frame, and it is to be understood that the overall structure being described can actually be oriented in any way in three-dimensional space.

Figure 1:
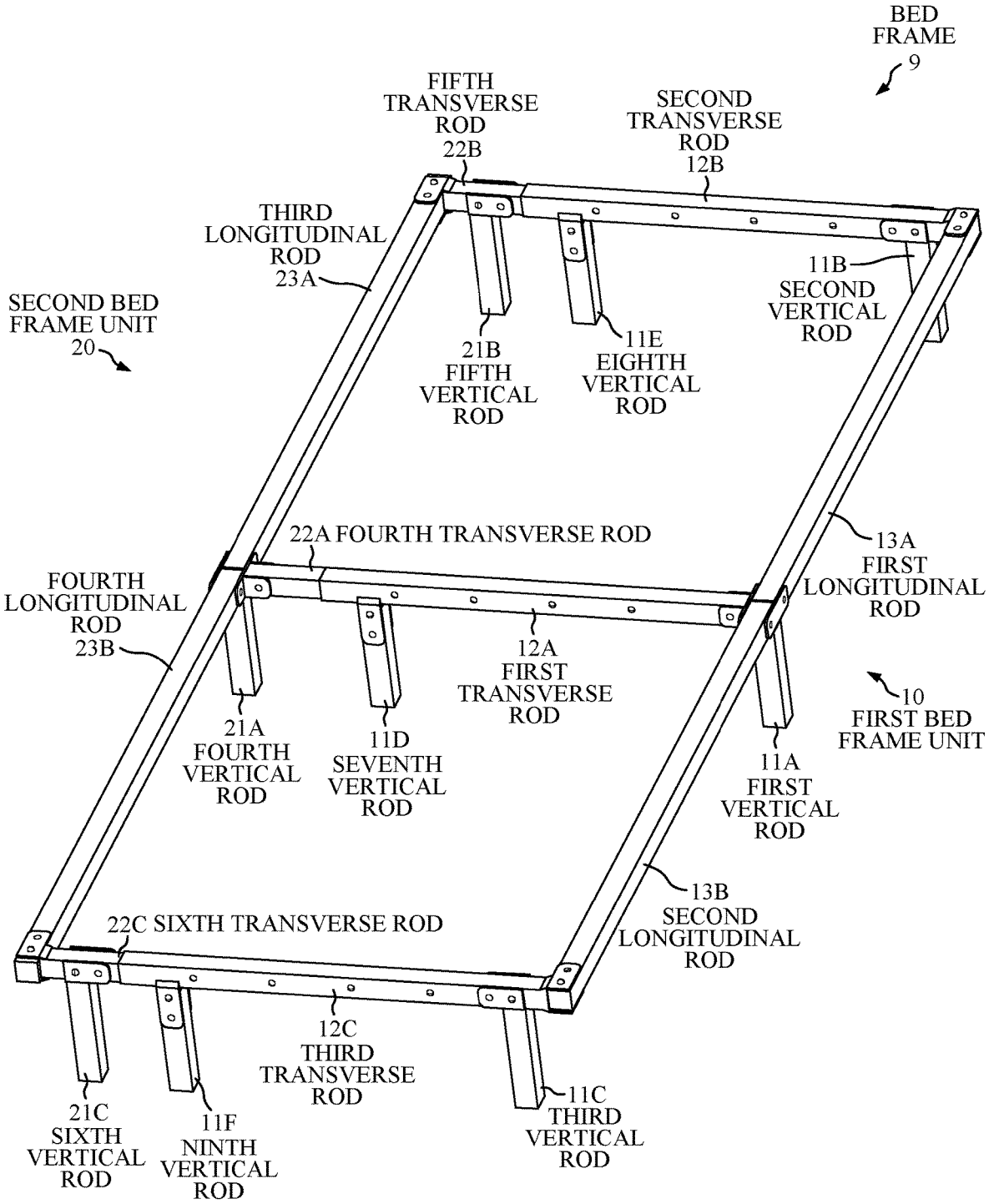
FIG. 1 is a top perspective view of the present invention in an assembled state.
Figure 2:
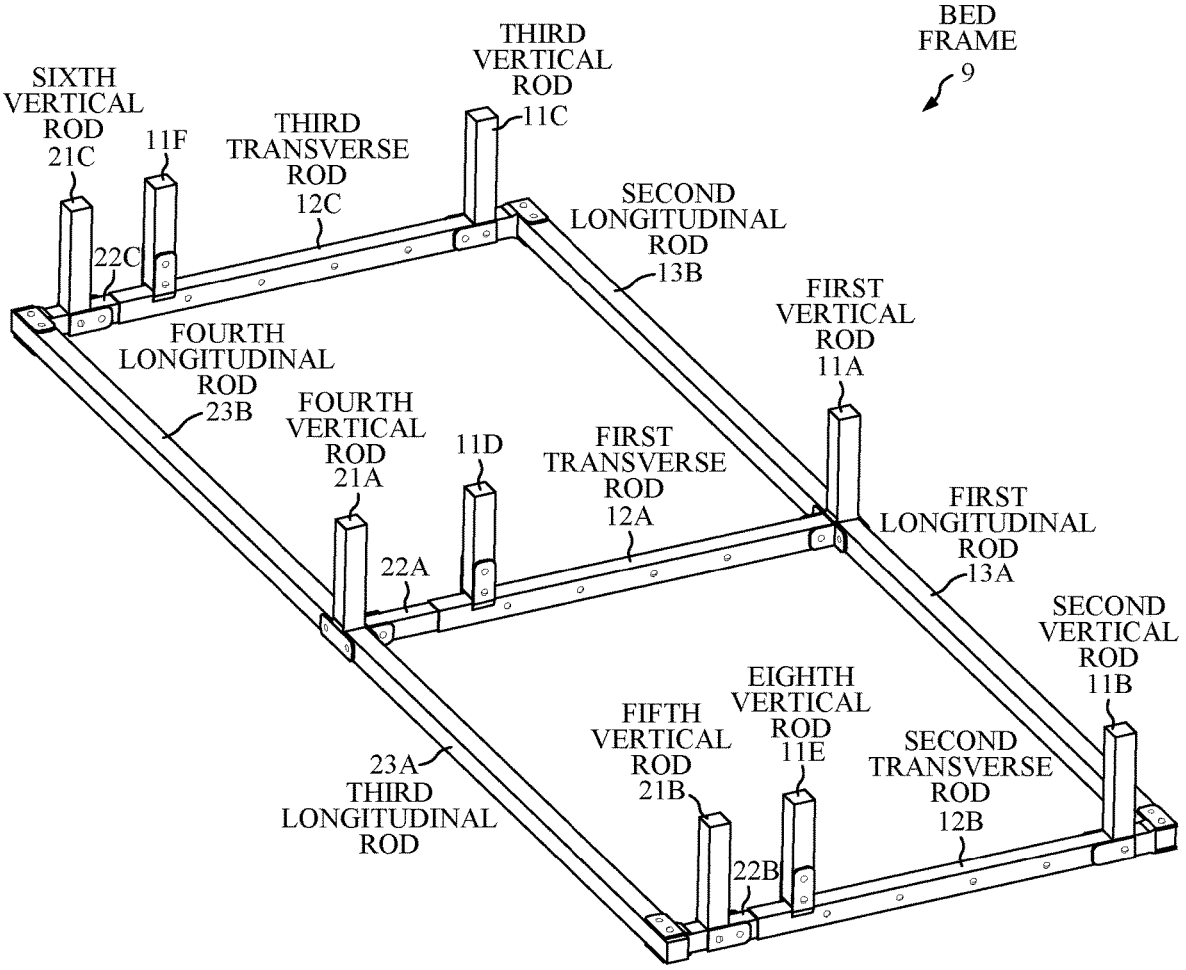
FIG. 2 is a bottom perspective view of the present invention in the assembled state.

FIG. 1 is an oblique perspective view from the top of a novel bed frame 9 that includes a first bed frame unit 10 and a second bed frame unit 20. FIG. 2 is an oblique perspective view from the bottom of bed frame 9.

The first bed frame unit 10 includes a first vertical rod 11A, a second vertical rod 11B, a third vertical rod 11C, a first transverse rod 12A, a second transverse rod 12B, a third transverse rod 12C, a first longitudinal rod 13A and a second longitudinal rod 13B. The first longitudinal rod 13A, the second longitudinal rod 13B, and a first end of the first transverse rod 12A are all pivotally attached to the upper end of the first vertical rod 11A and are all adapted to rotate downwards and to fold relative to the first vertical rod 11A. A first end of the second transverse rod 12B is pivotally attached at the other end of the first longitudinal rod 13A and is adapted to rotate horizontally and to fold relative to the first longitudinal rod 13A. A first end of the third transverse rod 12C pivots at the other end of the second longitudinal rod 13B and is adapted to rotate horizontally and to fold relative to the second longitudinal rod 13B. The upper end of the second vertical rod 11B is pivotally attached at a location towards an end of the second transverse rod 12B near the first longitudinal rod 13A. The second vertical rod 11B is adapted to rotate upwards and to fold relative to the second transverse rod 12B. The upper end of the third vertical rod 11C is pivotally attached at a location towards an end of the third transverse rod 12C near the second longitudinal rod 13B. The third vertical rod 11C is adapted to rotate upwards and to fold relative to the third transverse rod 12C.

The second bed frame unit 20 includes a fourth vertical rod 21A, a fifth vertical rod 21B, a sixth vertical rod 21C, a fourth transverse rod 22A, a fifth transverse rod 22B, a sixth transverse rod 22C, a third longitudinal rod 23A and a fourth longitudinal rod 23B. The third longitudinal rod 23A, the fourth longitudinal rod 23B, and a first end the fourth transverse rod 22A are all pivotally attached to the upper end of the fourth vertical rod 21A and are all adapted to rotate downwards and to fold relative to the fourth vertical rod 21A. A first end of the fifth transverse rod 22B pivots at the other end of the third longitudinal rod 23A and is adapted to rotate horizontally and to fold relative to the third longitudinal rod 23A. A first end of the sixth transverse rod 22C pivots at the other end of the fourth longitudinal rod 23B and is adapted to rotate horizontally and to fold relative to the fourth longitudinal rod 23B. The upper end of the fifth vertical rod 21B is pivotally attached at a location towards an end of the fifth transverse rod 22B near the third longitudinal rod 23A. The fifth vertical rod 21B is adapted to rotate upwards and to fold relative to the fifth transverse rod 22B. The upper end of the sixth vertical rod 21C is pivotally attached at a location towards an end of the sixth transverse rod 22C near the fourth longitudinal rod 23B. The sixth vertical rod 21C is adapted to rotate upwards and to fold relative to the sixth transverse rod 22C.

Each of the rods is a hollow metal bar. In the embodiment of FIG. 1, the rods have a square cross section. In other embodiments, the rods have rectangular or circular cross sections. Pairs of the first transverse rod 12A and the fourth transverse rod 22A, the second transverse rod 12B and the fifth transverse rod 22B, and the third transverse rod 12C and the sixth transverse rod 22C are each arranged to slide into one another in a telescoping manner so that the spacing between the first longitudinal rod 13A and the third longitudinal rod 23A is adjustable. For example, the square cross section of fourth transverse rod 22A is smaller than the square cross section of first transverse rod 12A such that rod 22A slides into rod 12A.

Figure 3:
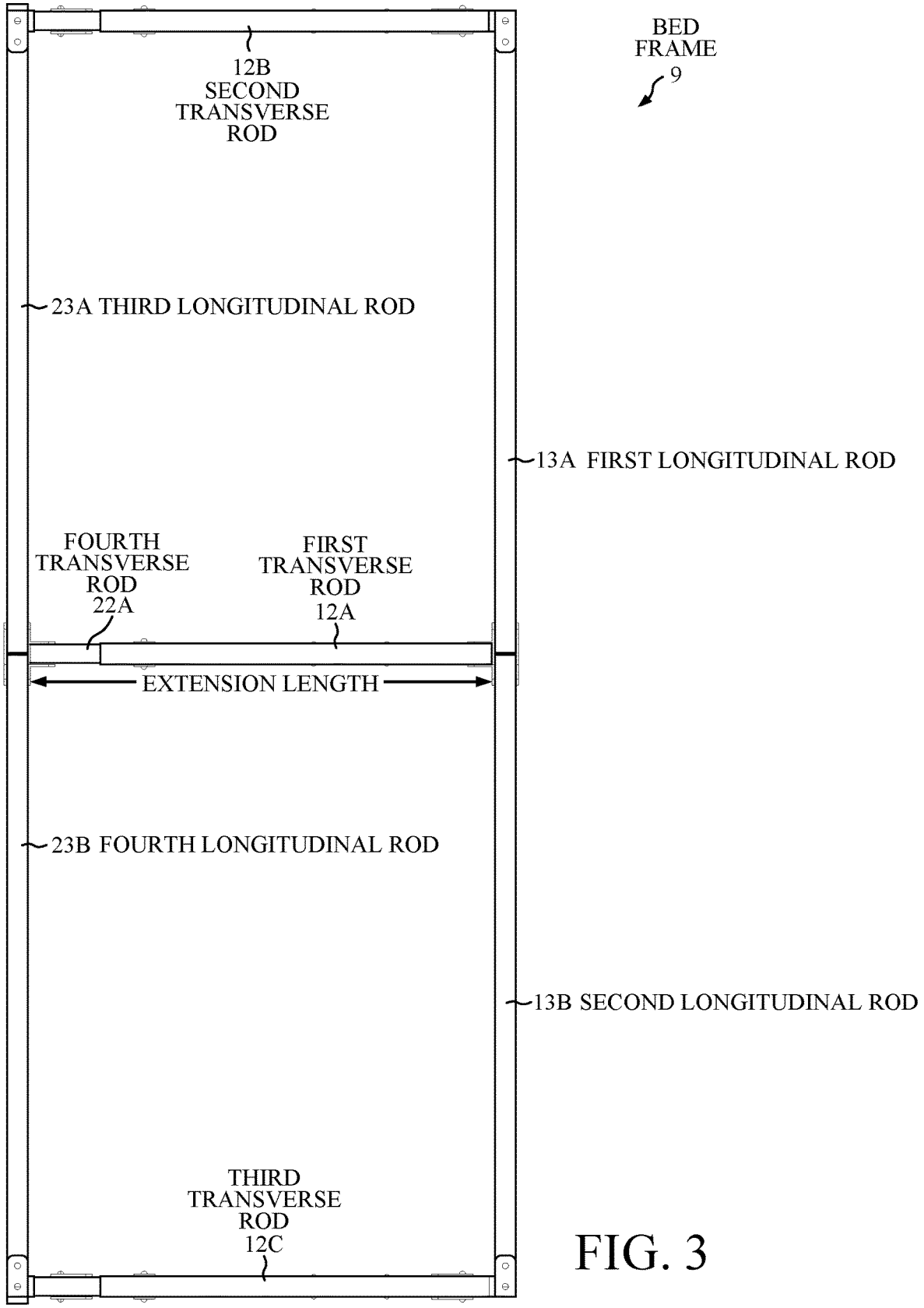
FIG. 3 is a top view of the present invention in the assembled state.

FIG. 3 shows that the length of the first longitudinal rod 13A is equal to that of the third longitudinal rod 23A, and the length of the second longitudinal rod 13B is equal to that of the fourth longitudinal rod 23B. The first bed frame unit 10 also includes a seventh vertical rod 11D, an eighth vertical rod 11E and a ninth vertical rod 11F. The upper end of the seventh vertical rod 11D is pivotally attached near the second end of the first transverse rod 12A opposite the first vertical rod 11A; the upper end of the eighth vertical rod 11E is pivotally attached near the second end of the second transverse rod 12B opposite the end that is attached to the first longitudinal rod 13A. The upper end of the ninth vertical rod 11F is pivotally attached at the second end of the third transverse rod 12C opposite the end that is attached to the second longitudinal rod 13B. The first transverse rod 12A, the second transverse rod 12B and the third transverse rod 12C are supported by the seventh vertical rod 11D, the eighth vertical rod 11E and the ninth vertical rod 11F, respectively, in order to improve the bearing capacity of the bed frame.

Each bed leg or vertical rod has the same length, including the first vertical rod 11A, the second vertical rod 11B, the third vertical rod 11C, the fourth vertical rod 21A, the fifth vertical rod 21B and the sixth vertical rod 21C, the seventh vertical rod 11D, the eighth vertical rod 11E and the ninth vertical rod 11F.

Figure 4:
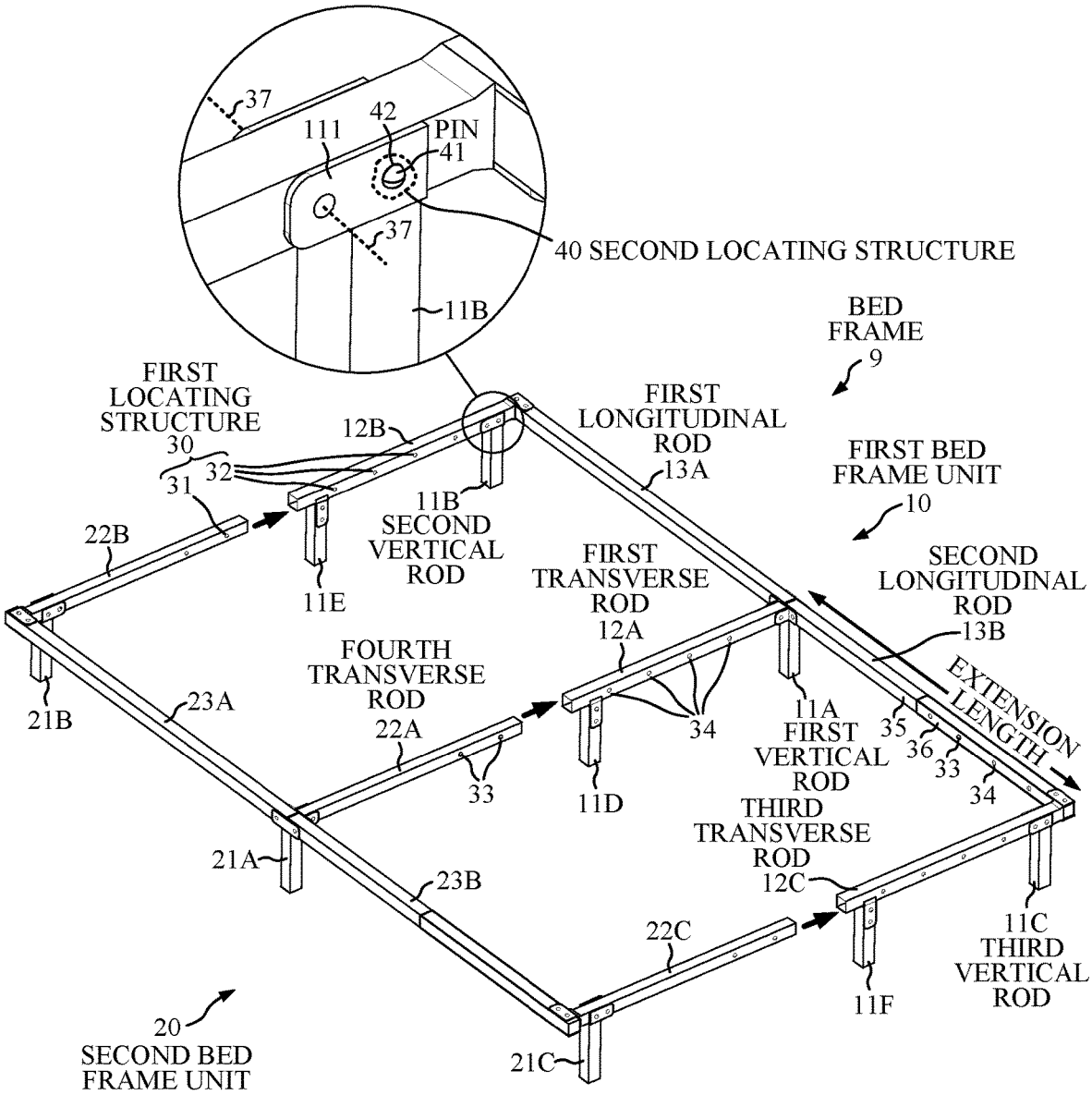
FIG. 4 is an exploded perspective view of the present invention being assembled.

FIG. 4 illustrates how the fourth transverse rod 22A, the fifth transverse rod 22B and the sixth transverse rod 22C slide inside the first transverse rod 12A, the second transverse rod 12B and the third transverse rod 12C, respectively, in a telescoping manner in order to allow the second bed frame unit 20 slide into the first bed frame unit 10 so as to vary the width of bed frame 9.

FIG. 4 shows a first locating structure 30 that includes a first locating pin 31 disposed on fifth transverse rod 22B and several first locating holes 32 disposed on second transverse rod 12B. The first locating pin 31 is spring loaded so that it protrudes out from the surface of fifth transverse rod 22B but can be pressed back in against the force of the spring. The first locating holes 32 are evenly spaced along the axial direction of the second transverse rod 12B. The first locating pin 31 fits into one of the first locating holes 32 in the assembled state of bed frame 9. The first locating structure 30 enables the relative positions of the telescoping transverse rods to be set at the selected location so as to achieve the desired combined extension length of the telescoped transverse rods. In order to readjust the extension length of telescoped transverse rods, the first locating pin 31 is pressed back into the first locating hole 32 from which it protruded before sliding the transverse rods relative to each other until the first locating pin 31 protrudes out from another first locating hole 32.

In a similar manner, locating pins 33 protrude from a vertical side surface of fourth transverse rod 22A, and locating holes 34 are present in a vertical side surface of first transverse rod 12A. The combined extension length of the telescoped transverse rods 22A and 12A is set at a selected length by inserting and sliding fourth transverse rod 22A into first transverse rod 12A until a locating pin 33 snaps out of the desired locating hole 34. If a narrower width of bed frame 9 is desired, then the locating pin 33 is pressed back into the locating hole 34 from which it protrudes, and rod 22A is inserted farther into rod 12A until the locating pin 33 snaps out of the next locating hole 34 that is located closer to the first vertical rod 11A. In another embodiment, two locating pins 33 pop out of two locating holes 34 to more securely set the desired extension length of the telescoped transverse rods 22A and 12A and to lock in the desired width of the bed frame 9.

In yet another embodiment, opposite longitudinal rods on the first and second bed frame units are each formed from two telescoping portions in a manner similar to transverse rods 22A and 12A. For example, the second longitudinal rod 13B includes a proximal portion 35 and a distal portion 36. The proximal portion 35 slides inside the distal portion 36 in a telescoping manner. The extension length of each longitudinal rod, and thus the longitudinal length of bed frame 9, can be adjusted using locating pins 33 and locating holes 34 on the two telescoping portions of the longitudinal rods. For example, a proximal locating pin 33 is disposed on the proximal portion 35, and a distal locating hole 34 is disposed in first distal portion 36. The proximal portion 35 and the distal portion 36 have a combined extension length that is set when the proximal locating pin 33 protrudes out through the distal locating hole 34.

By having adjustable length transverse and longitudinal rods, the same bed frame 9 can be used to support box springs and/or mattresses of different sizes. For example, the same bed frame 9 can be used as a mattress support for both a full size mattress as well as a twin XL size mattress. A bed frame 9 that is adjustable for both queen size and king size mattresses is also possible. By designing both the transverse and longitudinal rods in a telescoping manner, in the folded state both the first bed frame unit 10 and the second bed frame unit 20 can fit inside a single packing box whose longest dimension is less than half of the longitudinal length of bed frame 9 in its assembled state.

FIG. 4 also shows a second locating structure 40 that is used to lock in place two rods that are pivotally attached to one another. The second locating structure 40 is arranged between two rods that rotate about each other in order to prevent the rods from pivoting in the assembled state. The second locating structure 40 includes a locking locating pin 41 disposed on one rod piece and a locking locating hole 42 disposed in another rod piece. The locking locating pin 41 fits into the locking locating hole 42 in the assembled state so as to fix the relative position of the two rods and to prevent rotational movement. If folding is desired, the locking locating pin 41 is pressed back in to the locking locating hole 42, and then the two rod pieces are folded into one another by pivoting about an axis 37.

In the example of the second vertical rod 11B that folds out from the second transverse rod 12B in the assembled state, the upper end of the second vertical rod 11B is provided with a pivoting portion 111, and one end of the pivoting portion 111 pivots about the axis 37 with respect to the second transverse rod 12B. The locking locating hole 42 is disposed at the other end of the pivoting portion 111, and the locking locating pin 41 is disposed on and protrudes from the second transverse rod 12B.

The first locating pin 31, the locating pins 33, and the locking locating pin 41 are all spring loaded and composed of a spring and a ball. The ball is pressed by the spring and partially protrudes out of the locating hole.

Figure 5:
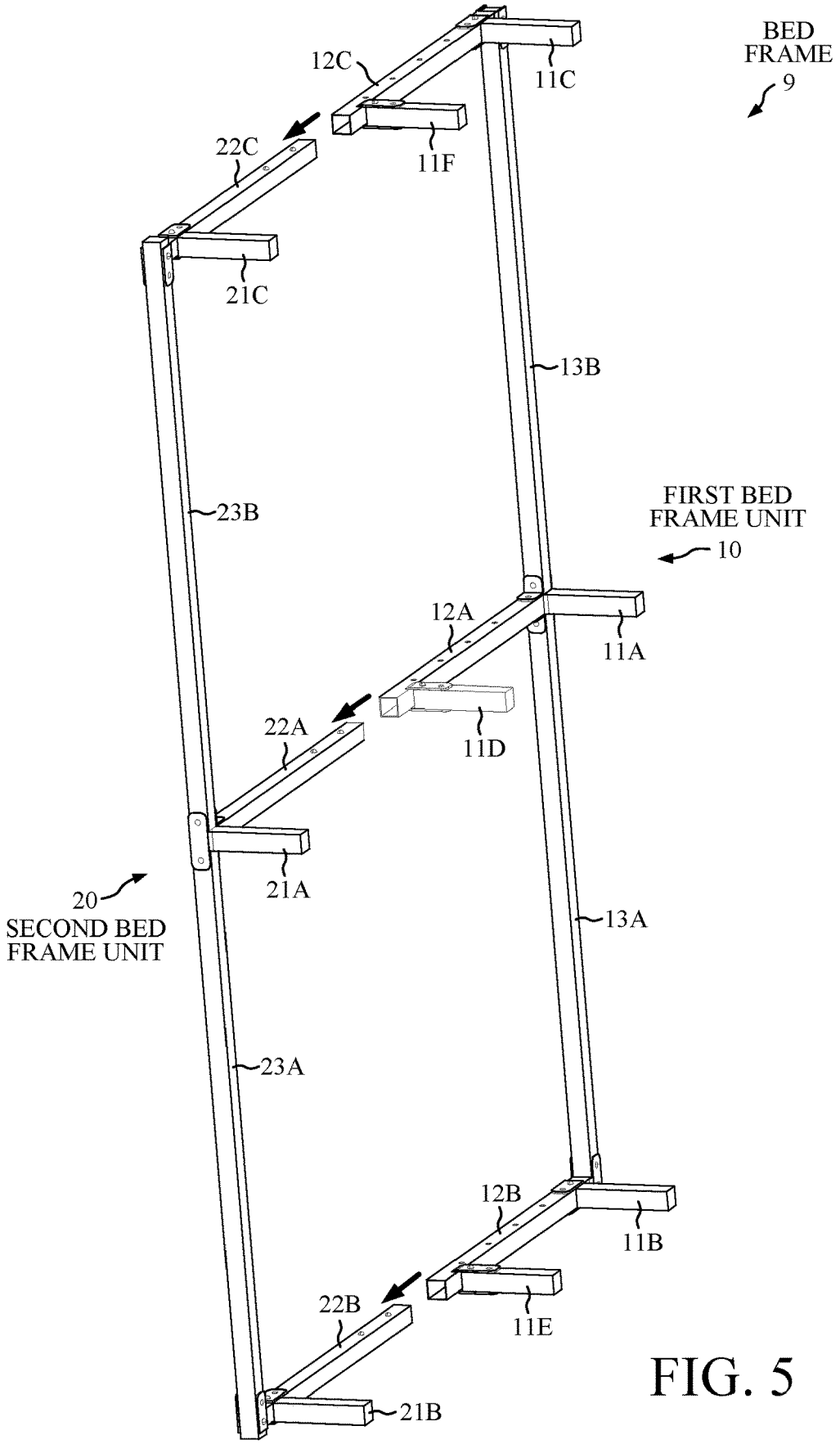
FIG. 5 is an exploded view of the present invention being disassembled from the assembled state into a folded state.
Figure 6:
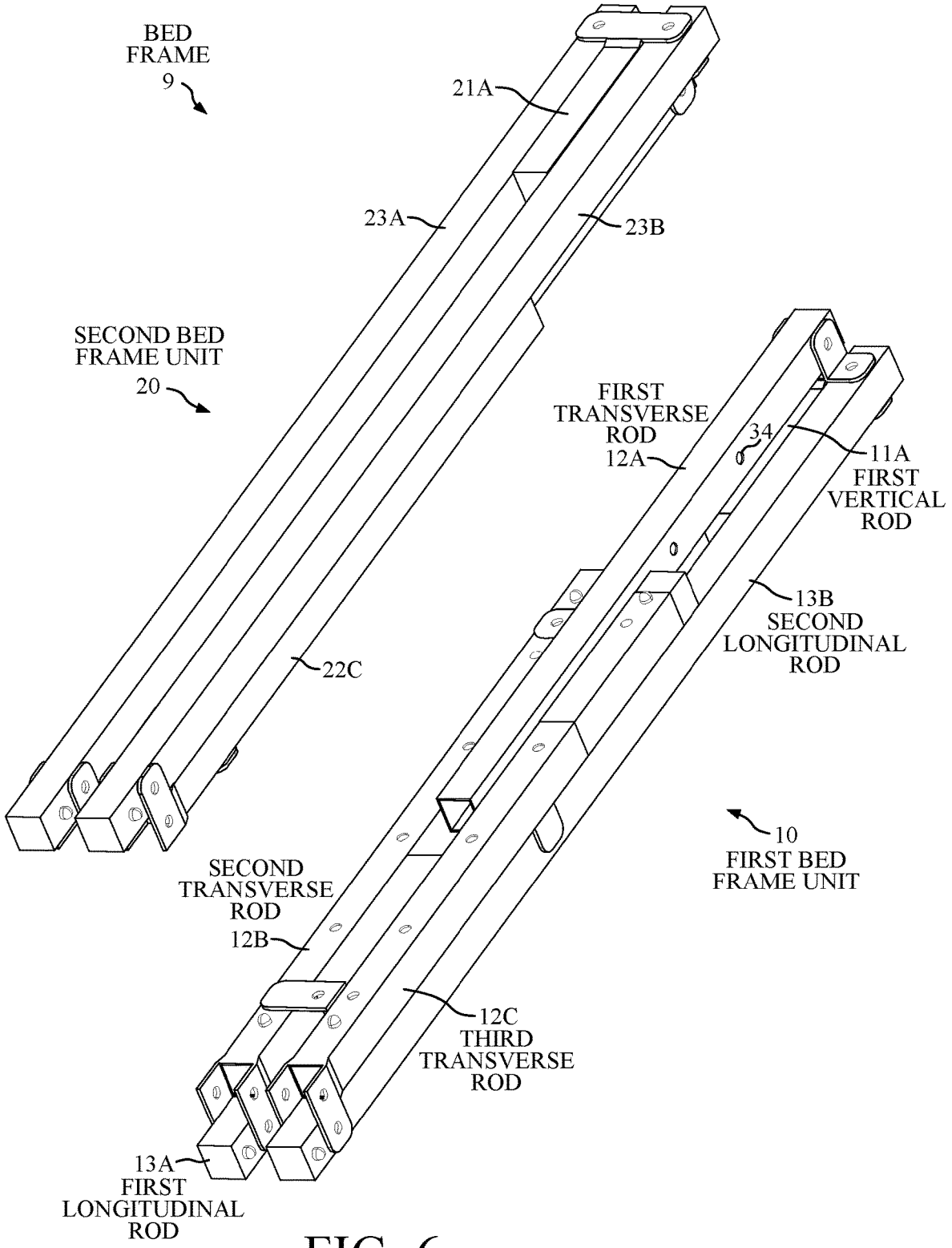
FIG. 6 is a perspective view of the present invention in the folded state.

FIG. 5 illustrates separating the first bed frame unit 10 from the second bed frame unit 20 so that bed frame 9 can be returned to its folded state from its assembled state. If it is desired to fold the bed frame 9 into its folded state, the first bed frame unit 10 and the second bed frame unit 20 are first separated. Then each transverse rod, longitudinal rod and vertical rod is folded inwards to form two bundles of rod pieces as shown in FIG. 6 so that the occupied space is greatly reduced.

The first bed frame unit 10 and the second bed frame unit 20 are split into two parts and then folded so that the rod pieces forming the first bed frame unit 10 and the second bed frame unit 20 can be folded separately into a bundle structure. The resulting two rod bundles achieve a smaller packaging volume folding, save storage space and reduce transportation costs.

REFERENCE NUMERALS

9 bed frame
10 first bed frame unit
11A first vertical rod
11B second vertical rod
111 pivoting portion
11C third vertical rod
11D seventh vertical rod
11E eighth vertical rod
11F ninth vertical rod
12A first transverse rod
12B second transverse rod
12C third transverse rod
13A first longitudinal rod
13B second longitudinal rod
20 second bed frame unit
21A fourth vertical rod
21B fifth vertical rod
21C sixth vertical rod
22A fourth transverse rod
22B fifth transverse rod
22C sixth transverse rod
23A third longitudinal rod
23B fourth longitudinal rod
30 first locating structure
31 first locating pin
32 first locating hole
33 locating pins
34 locating holes
35 proximal portion
36 distal portion
37 pivoting axis
40 second locating structure
41 locking locating pin
42 locking locating hole Although the present invention has been described in connection with certain specific embodiments for instructional purposes, the present invention is not limited thereto. Accordingly, various modifications, adaptations, and combinations of various features of the described embodiments can be practiced without departing from the scope of the invention as set forth in the claims.

What is claimed is:

1. A bed frame, comprising:

a first bed frame unit that includes a first longitudinal rod, a second longitudinal rod, a first transverse rod, a second transverse rod, a third transverse rod, and a first vertical rod, wherein the first longitudinal rod, the second longitudinal rod, and the first transverse rod are all pivotally attached to the first vertical rod, and wherein a first locating hole passes through a side of the first transverse rod; and a second bed frame unit that includes a third longitudinal rod, a fourth longitudinal rod, a fourth transverse rod, a fifth transverse rod, a sixth transverse rod, and a second vertical rod, wherein the third longitudinal rod, the fourth longitudinal rod, and the fourth transverse rod are all pivotally attached to the second vertical rod, wherein a locating pin is disposed on a side of the fourth transverse rod, wherein in an assembled state of the bed frame the fourth transverse rod fits inside the first transverse rod, and wherein in the assembled state the locating pin protrudes out through the first locating hole in the first transverse rod.

2. The bed frame of claim 1, wherein in the assembled state the fifth transverse rod fits inside the second transverse rod, and the sixth transverse rod fits inside the third transverse rod.

3. The bed frame of claim 1, wherein the first longitudinal rod, the second longitudinal rod, and the first transverse rod are all pivotally attached at an upper end of the first vertical rod.

4. The bed frame of claim 1, wherein the first transverse rod is a hollow metal bar with a square cross section, and wherein the first locating hole is dispose in a vertical side of the first transverse rod.

5. The bed frame of claim 1, wherein the locating pin includes a spring and a ball, and wherein in the assembled state the ball is pressed by the spring towards the first locating hole and partially protrudes out of the first locating hole.

6. The bed frame of claim 1, wherein a second locating hole is disposed in the side of the first transverse rod, and wherein the fourth transverse rod and the first transverse rod have a combined extension length that is shorter when the locating pin protrudes out of the second locating hole than when the locating pin protrudes out of the first locating hole.

7. The bed frame of claim 1, wherein the first bed frame unit includes a third vertical rod pivotally attached to the second transverse rod, wherein the third vertical rod includes a pivoting portion that has a locking locating hole, wherein the second transverse rod has a locking locating pin, and wherein the third vertical rod is prevented from pivoting with respect to the second transverse rod when the locking locating pin fits into the locking locating hole.

8. The bed frame of claim 1, wherein the first longitudinal rod includes a first proximal portion and a first distal portion, wherein the first proximal portion slides inside the first distal portion, wherein a proximal locating pin is disposed on the first proximal portion, wherein a distal locating hole is disposed in the first distal portion, and wherein the first proximal portion and the first distal portion have a combined extension length that is set when the proximal locating pin protrudes out through the distal locating hole.

9. The bed frame of claim 1, wherein the bed frame has a longitudinal length in the assembled state, and wherein in a folded state of the bed frame both the first bed frame unit and the second bed frame unit fit inside a single packing box whose longest dimension is less than half of the longitudinal length of the bed frame in the assembled state.

10. A bed frame, comprising:

a first longitudinal rod;

a second longitudinal rod;

a third longitudinal rod;

a fourth longitudinal rod;

a first transverse rod, wherein a first locating hole is disposed in the first transverse rod;

a second transverse rod, wherein a locating pin is disposed on the second transverse rod;

a first vertical rod, wherein the first longitudinal rod, the second longitudinal rod, and the first transverse rod are all pivotally attached to the first vertical rod; and a second vertical rod, wherein the third longitudinal rod, the fourth longitudinal rod, and the second transverse rod are all pivotally attached to the second vertical rod, wherein in an assembled state of the bed frame the second transverse rod fits inside the first transverse rod, and wherein in the assembled state the locating pin protrudes out of the first locating hole in the first transverse rod.

11. The bed frame of claim 10, wherein the first transverse rod is a hollow metal bar with a square cross section, and wherein the first locating hole is dispose in a vertical side of the first transverse rod.

12. The bed frame of claim 10, wherein the locating pin includes a spring and a ball, and wherein in the assembled state the ball is pressed by the spring towards the first locating hole and partially protrudes out of the first locating hole.

13. The bed frame of claim 10, wherein a second locating hole is disposed in the side of the first transverse rod, and wherein the second transverse rod and the first transverse rod have a combined extension length that is shorter when the locating pin protrudes out of the second locating hole than when the locating pin protrudes out of the first locating hole.

14. The bed frame of claim 10, further comprising:

a third vertical rod pivotally attached to the first transverse rod, wherein a pivot bracket is fixedly attached to the first transverse rod and includes a locking locating hole, wherein the third vertical rod has a locking locating pin, and wherein the third vertical rod is prevented from pivoting with respect to the first transverse rod when the locking locating pin fits into the locking locating hole.

15. The bed frame of claim 10, wherein the first longitudinal rod includes a proximal portion and a distal portion, wherein the proximal portion slides inside the distal portion, wherein a proximal locating pin is disposed on the proximal portion, wherein a distal locating hole is disposed in the distal portion, and wherein the proximal portion and the distal portion have a combined extension length that is set when the proximal locating pin protrudes out of the distal locating hole.

16. The bed frame of claim 10, wherein the bed frame has a longitudinal length in the assembled state, and wherein in a folded state of the bed frame all of the first longitudinal rod, the second longitudinal rod, the third longitudinal rod, the fourth longitudinal rod, the first transverse rod, the second transverse rod, the first vertical rod, and the second vertical rod fit inside a single packing box whose longest dimension is less than half of the longitudinal length of the bed frame in the assembled state.

17. A boxed bed frame, comprising:

a first bed frame unit that includes a first longitudinal rod, a second longitudinal rod, a first transverse rod, and a first vertical rod, wherein the first longitudinal rod, the second longitudinal rod, and the first transverse rod are all pivotally attached to the first vertical rod, and wherein a first locating hole is disposed in the first transverse rod;

a second bed frame unit that includes a third longitudinal rod, a fourth longitudinal rod, a second transverse rod, and a second vertical rod, wherein the third longitudinal rod, the fourth longitudinal rod, and the second transverse rod are all pivotally attached to the second vertical rod, wherein a locating pin is disposed on the second transverse rod, wherein in an assembled state of the bed frame the second transverse rod slides inside the first transverse rod, and wherein in the assembled state the locating pin protrudes out of the first locating hole in the first transverse rod; and a single packing box, wherein the bed frame has a longitudinal length in the assembled state, and wherein in a compact state of the bed frame both the first bed frame unit and the second bed frame unit fit inside the single packing box whose longest dimension is less than half of the longitudinal length of the bed frame in the assembled state.

18. The boxed bed frame of claim 17, wherein the bed frame has a transverse width in the assembled state, wherein a second locating hole is disposed in the first transverse rod, and wherein the transverse width of the bed frame is adjustable by moving the locating pin from the first locating hole to the second locating hole.

19. The boxed bed frame of claim 17, wherein the locating pin includes a spring and a ball, and wherein in the assembled state the ball is pressed by the spring towards the first locating hole and partially protrudes out of the first locating hole.

20. The boxed bed frame of claim 17, wherein the first transverse rod is a hollow metal bar with a square cross section, and wherein the first locating hole is dispose in a side of the first transverse rod.

* * * * *